US005525078A

United States Patent [19]

Springer

[11] Patent Number: 5,525,078

[45] Date of Patent: Jun. 11, 1996

[54] ELECTRICAL PLUG CONNECTOR

[75] Inventor: Markus Springer, Cheltenham, England

[73] Assignee: Krone Aktiengesellschaft, Berlin-Zehlendorf, Germany

[21] Appl. No.: 316,726

[22] Filed: Oct. 3, 1994

[30] Foreign Application Priority Data

Oct. 5, 1993 [DE] Germany ..... 43 34 615.4

[51] Int. Cl.[6] ..... H01R 23/10

[52] U.S. Cl. ..... 439/610; 439/395

[58] Field of Search ..... 439/607–610, 439/395, 404, 696, 701, 724

[56] References Cited

U.S. PATENT DOCUMENTS 5,074,804 12/1991 Pantland et al. .
5,199,891 4/1993 Reed ..... 439/610

FOREIGN PATENT DOCUMENTS

0445376A1 11/1990 European Pat. Off. .
8804841 6/1988 WIPO ..... 439/610

OTHER PUBLICATIONS

IBM Technical Disclosure Bulletin, vol. 16, No. 5, Oct. 1973.

*Primary Examiner* Larry I. Schwartz
*Assistant Examiner* J. DeMello
*Attorney, Agent, or Firm* McGlew and Tuttle

[57] ABSTRACT

An electrical plug connector for the telecommunications and data transfer includes RJ contacts disposed in a housing and insulation displacement contacts and contact strips connecting the insulation displacement contacts. Shielding of a h.f. cable is provided using a shield contact that can be terminated at the plug connector whereby the cable shield of the h.f. cable can be connected to ground potential, or can be conducted on, and that the contact between the shield contact and the cable shield is established by means of a clamp connection.

19 Claims, 3 Drawing Sheets

ELECTRICAL PLUG CONNECTOR

FIELD OF THE INVENTION

The invention relates to an electrical plug connector for telecommunication and data transfer applications, the plug including RJ contacts disposed in a housing and insulation displacement contacts and contact strips connected to the insulation displacement contacts.

BACKGROUND OF THE INVENTION

A plug connector of the type referred to hereinbefore is known in the art from EP 0,445,376 A1 (see also U.S. Pat. No. 5,074,804). The plug connector includes a housing with a receiving chamber for the plug, a first set of contacts in insulation displacement technology, and a second set of contacts (RJ contacts) connected with the first set and made of elongated contact strips inserted into grooves of the upper housing portion and guided closely to each other and in parallel right into the receiving chamber, wherein to the plug (RJ plug) can be inserted. The shielding of high frequency (h.f.) cables is performed by contacting the cable shield of the h.f. cable to another, additional contact. This additional contact prevents a compact construction of the plug connector.

SUMMARY AND OBJECTS OF THE INVENTION

It is therefore the object of the invention to improve an electrical plug connector of the type referred to hereinbefore such that a shielding of h.f. cables integrated in the plug connector is made possible.

According to the invention, an electrical plug connector for telecommunication and data transfer applications is provided comprising RJ contacts disposed in a housing and insulation displacement contacts and contact strips connected to the insulation displacement contacts. For shielding a h.f. cable, a shield contact is terminated at the plug connector, by means of which the cable shield of the h.f. cable can be connected to ground potential, or can be conducted on, and that the contact between the shield contact and the cable shield is established by means of a clamp connection.

By application, according to the invention, of a shield contact, the shielding cable of a h.f. cable can safely be connected to the shield contact, by means of a squeeze connection, and can be connected, over the intermediate ground wire contact, to ground potential or can be conducted on.

The shield contact preferably has at least two lateral brackets and a rear wall serving for attachment of the shield contact at the plug connector, at the same time conductively connecting the intermediate ground wire contact to the shield contact. The intermediate earth wire contact is intended for contacting intermediate earth wires and generally comprises a resilient metal sheet which hooks resiliently, clamping down the intermediate ground wire. The intermediate earth wire contact is preferably provided with fixing elements, in particular barbs, webs, flanges and rear walls serving for attachment at the plug connector. The shield contact is preferably formed so that the plug connector has an electrical conductive enclosure, whereby the impedance between the h.f. cable and the flanges is as low as possible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
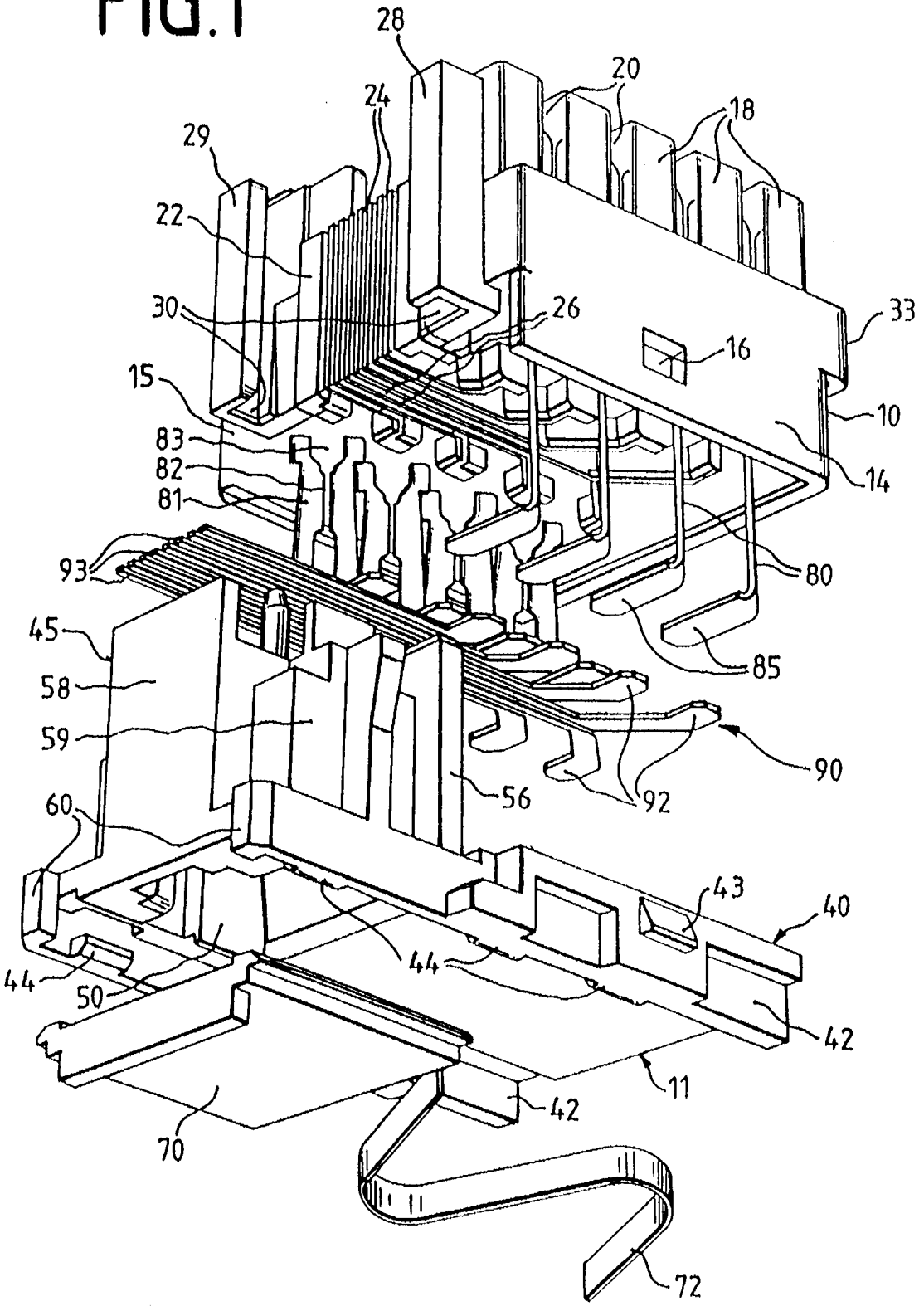
FIG. 1 is an exploded perspective view of a plug connector as known in the art from U.S. Pat. No. 5,074,804.

The plug connector 25 known in the art from U.S. Pat. No. 5,074,804 and EP 0,445,376 (U.S. Pat. No. 5,074,804 is hereby incorporated by reference), according to FIG. 1, comprises a molded housing having an upper or IDC portion 10 and a lower or RJ portion 11. The upper portion 10 has opposed, substantially rectangular side walls 14, 15, each provided with a through-opening 16 for latching with wedge-type projections 43 of the lower portion 11. On the upper side of the upper portion 10, close to each side wall 14, 15, extend two rows of column-type extensions 18 forming clamping elements, between which slots 20 are formed and receive—as will be described below—electrically conductive connection elements 80 with integrally formed, angled, flat foot sections 85. The front-side end wall 22 of the upper portion 10 is provided with a row of parallel grooves 24, being in connection with similar grooves 26 formed in the lower wall of the upper portion 10. Each of the grooves 26 extends closely up to a lower part of slots 20 defined by the column-type extensions 18. The front-side end wall 22 further comprises, opposed, molded-in and angled, flange-type side portions 28, 29, each forming a channel 30. At the opposed front side, the upper portion 10 is provided with integrated hooks 34 forming clamping elements for electrical conductors.

The lower portion 11 is provided with a substantially flat end section 40 having opposed side walls 42, the outside surfaces of which are provided with wedge-type projections 43. On the inner side of each side wall 42 are provided inwardly directed flanges 44. A front end or socket section 45 of the lower portion 11 includes a molded-in part defining a hollow space 50 for receiving a plug, such as a plug disposed at the tail of a cord coming from a telephone set or a computer terminal device. Close to the first end section 40, approximately in the center of the lower portion 11, are formed opposedly disposed, upright columns 56. The lower portion 11 comprises, on its front, a plane wall 58 uprightly extending in a height of approximately the height of the columns 56. The other end of the wall 58 terminates at projecting portions 60 of each of the side walls 42. The lower portion may receive a closure cover 70 being disposed between the opposed side walls 42 and held in position by the flanges 44. The closure cover 70 may be displaced between a position, wherein it blocks an opening for access to the hollow space 50, and a position, wherein the hollow space 50 is open. A spring 72 is attached at the closure cover 70, in order to pre-tension it towards the closed position.

The set of eight electrical connection elements 80 extends into the slots 20 in the upper portion 10 formed by the column-type extensions 18. Each of the connection elements 80 is provided with an insulation displacement contact element 81 having a fork-type shape and defining a relatively narrow contact slot 82 terminating in a wide insertion section 83. The arrangement is adapted such that, when inserting an electrically insulated conductor into the insertion section 83, and when pressing the conductor into the narrow contact slot 82, the insulation of the conductor will automatically be cut-in, so that a contact between the central core of the conductor and the material of the connection element 80 will be established. The insulation displacement contact elements 81 are substantially flat and are disposed at an angle of approximately 45° to a line through the column-type extensions 18, i.e. at 45° to the plane of each slot 20. Each connection element 80 is, further, provided with a foot section 85, being integrally formed with the insulation displacement contact elements 81.

A second set of connection elements 90 comprise a row of eight contact tongues 92. These contact tongues are each welded to the foot sections 85. An elongated contact strip 93 extends from each contact tongue 92. The contact strips 93 are adapted such that they extend in parallel to each other. The contact strips 93 terminate as RJ contacts in the hollow space 50 for the RJ plugs of terminal devices.

Figure 2:
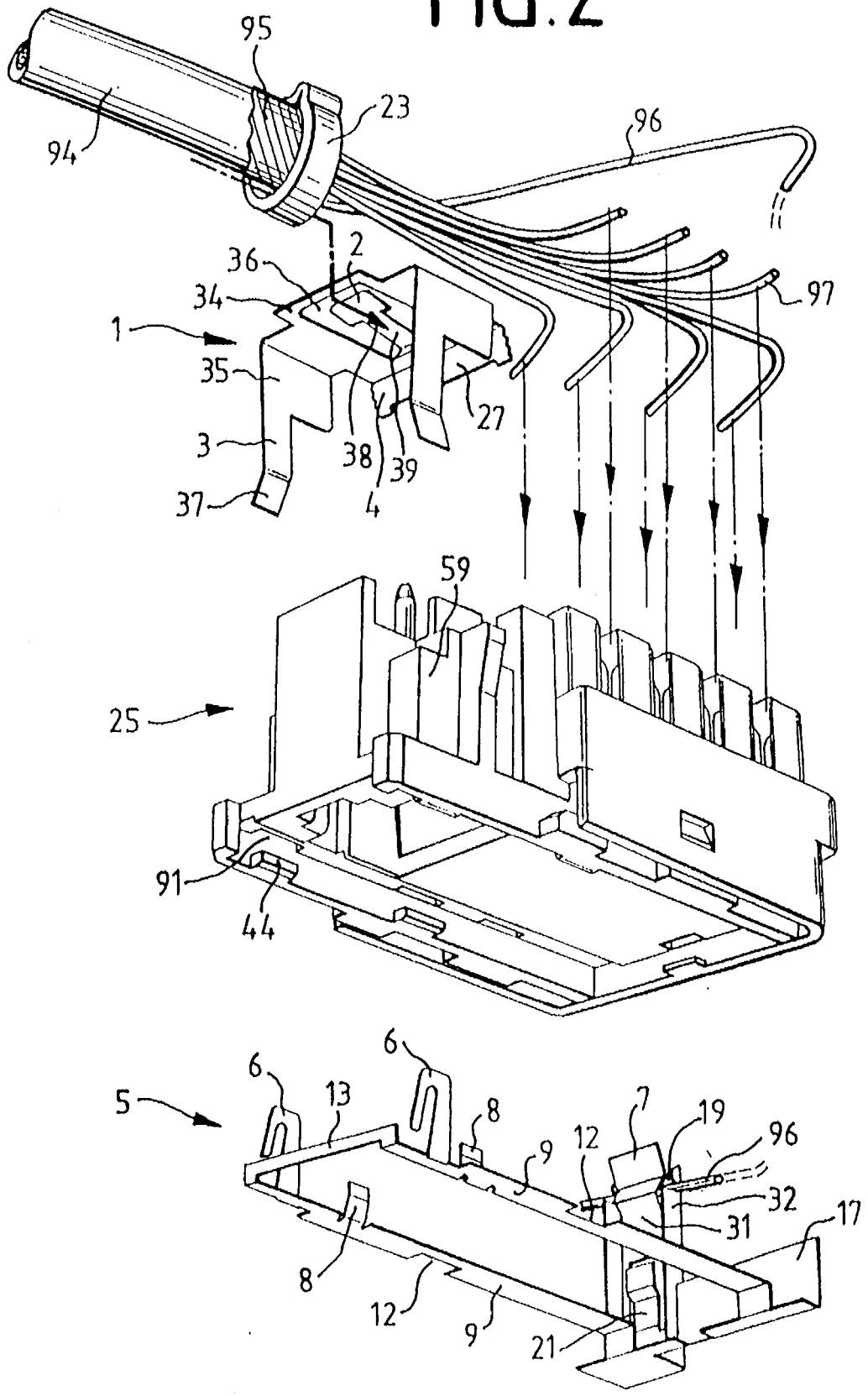
FIG. 2 is an assembled plug connector according to FIG. 1, with a shield contact and an intermediate ground wire contact, in an exploded view, with the h.f. cable to be terminated and a squeezing ring according to the invention.
Figure 3:
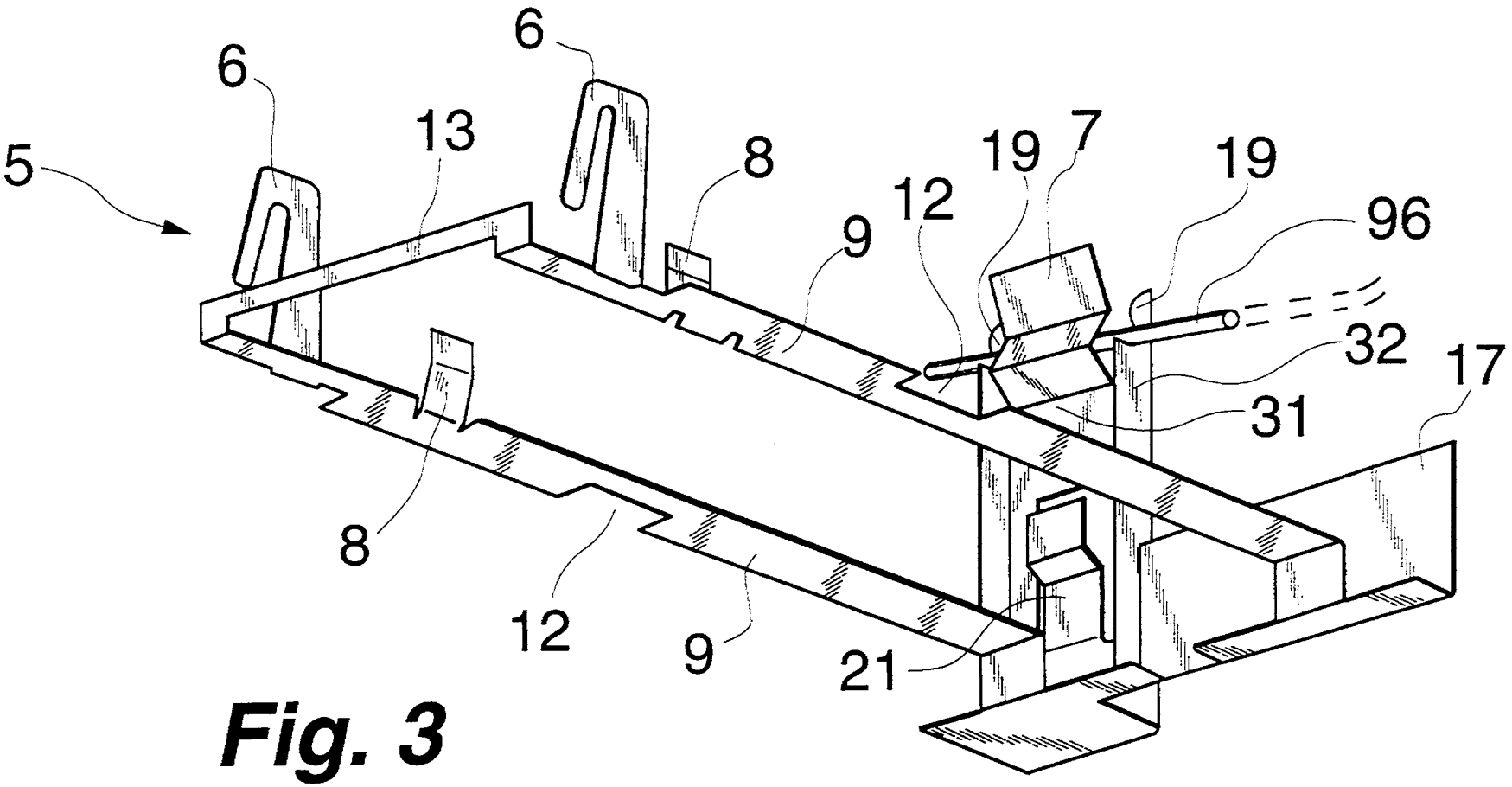
FIG. 3 is an enlarged view of the intermediate ground wire contact.

FIG. 2 shows the assembled plug connector 25 described in detail in FIG. 1 and having a shield contact 1 and an intermediate ground wire contact 5. In addition, the h.f. cable 94 is shown with a squeezing ring 23.

The shield contact 1 is formed as one piece of a shaped metal sheet 34. At two opposite sides, the shaped metal sheet 34 is bent downwardly in two rectangular angled portions 35. These extend first over the full width of the shaped metal sheet 34, become narrow then and form brackets 3 with spring lugs 37 that are adapted rectangularly and are bent off outwardly at their ends at an obtuse angle. In the center of the shaped metal sheet 34, there is a U-shaped cut-free portion 36 forming an upwardly bendable lip 2 of the shield contact 1. Therein, the bendable lip 2 projects over the angled portion 35 forming the bracket 3. In the central area, the lip 2 is provided with rectangular cut-free portions 37. This allows a web 39, being slightly narrower only than the lip 2, to project in the center of the shaped metal sheet 34, over the lateral angled portion 35. At the rear end of the shaped metal portion 34 there is provided another angled portion 27 forming the rear wall 4 of the shield contact 1.

The intermediate ground wire contact 5 is, same as the shield contact 1, formed as one piece of a shaped metal sheet which has narrow webs 9 at the longitudinal sides. At the front side, the shaped metal portion is bent off upwardly by 90°, and forms the front side 13. At the outer sides of the webs 9, close to the front side 13, are provided barbs 6 being bent off upwardly at right angles. Adjacent to the barbs 6, at the inner sides of the webs 9, flanges 8 are bent off upwardly at right angles. Further, indentations 12 are formed at the outer sides of the webs 9. At the ends directed away from the front side 13, the webs 9 are bent off downwardly at right angles and extend then in a plane being parallel to the original plane of the webs 9. At the outer side of the front-side web 9 of FIG. 2 upwardly projects a wall 17, the rear-side web 9 being in part cut free in the area of the wall 17. Here, the left-hand side of the rear-side web 9 is slightly widened towards the outside. From the outer side of the widened web 9 is a metal sheet 31 upwardly bent off at a right angle, the metal sheet comprising inwardly directed angled portions 32 at both sides. In the lower part of the metal sheet 31, a tongue 21 is cut free from the center, the tongue being two times inwardly bent off. There above, the metal sheet 31 is cut free from the inwardly directed lateral angled portions 32. The thus cut-free part of the metal sheet 31 acts as a resilient metal sheet 7. In the upper area of the resilient metal sheet 7, the inwardly directed lateral angled portions 32 are cut away, thereby inwardly rounded hooks 19 being formed.

In the following, the assembly of the shield contact 1 and of the intermediate ground wire contact 5 with the h.f. cable 94 and with the plug connector 25 will be described. The lip 2 cut-free from the shaped metal sheet 34 is upwardly bent away. The h.f. cable 94 to be shielded is stripped, and the made-free cable shield 95 is bent off rearwardly onto the remaining insulation. By means of a squeeze connection, the cable shield 95 is bent off rearwardly onto the remaining insulation. Also by means of a squeeze connection, the cable shield 95 is connected to the lip 2 of the shield contact 1. The squeeze connection is preferably made by means of a squeezing ring 23, as is shown in FIG. 2. The squeeze connection can however also be made by means of a cable binder having a metal bracket. The eight cables 97 of the h.f. cable 94 are contacted by means of the insulation displacement contact elements 81. The rear wall 4 of the shield contact 1 is inserted into the remaining slot between the grooves 24 of the upper portion 10 and the lower portion 11. The brackets 3 of the shield contact 1 are bent away from the wall 59 of the lower portion 11 at an obtuse angle. This serves for simple introduction of the barbs 6 of the intermediate ground wire contact 5 through the through-passing portion 91 of the lower portion 11. The barb 6 is then conductively positioned with the bracket 3 of the shield contact 1 against the wall 59 of the lower portion 11. After the barb 6 having been inserted through the through-passing portion 91, its bent-off portion will be placed on the upper side of the portion 60, and fixes thus the intermediate ground wire contact 5 at the lower portion 11 of the plug connector 25. The flanges 8 of the intermediate ground wire contact 5 rest against the inner walls of the hollow portion 50 of the plug connector 25 and serve for further fixing. The webs 9 of the intermediate ground wire contact 5 lie flatly on the underside of the lower portion 11 of the plug connector 25. The flanges 8 of the intermediate ground wire contact 5 rest against the inner walls of the hollow portion 50 of the plug connector 25 and serve for further fixing. The webs 9 of the intermediate ground wire contact 5 lie flatly on the underside of the lower portion 11 of the plug connector 25. The indentations 12 of the intermediate ground wire contact 5 are guided past the flanges 44 of the lower portion 11. The front side 13 is guided between the two portions 60 of the lower portion 11 and rests, in the lower portion, against the wall 58 of the lower portion 11. The wall 17 of the intermediate ground wire contact 5, serving for fixing, rests against the rear wall of the upper portion 10, the wall not being visible in the illustrated perspective view.

The actual intermediate ground wire contact 5 is formed by the resilient metal sheet 7 and the hooks 19. When an intermediate ground wire 96 is present, it will be connected to the intermediate ground wire contact 5. For this purpose, the resilient metal sheet 7 is pressed between the hooks 19 in the direction of the barbs 6. The intermediate ground wire 96 is then resiliently clamped down between the resilient metal sheet 7 and the hooks 19. The construction of the actual intermediate ground wire contact 5, formed of the hooks 19 and the resilient metal sheet 7, rests against the rear wall of the last column-type extension 18 of the upper portion 10 of the plug connector 25. The closure cover 70 described in FIG. 1 can even be slid onto the plug connector 25 when applying an intermediate ground wire contact 5.

While a specific embodiment of the invention has been shown and described in detail to illustrate the application of the principles of the invention, it will be understood that the invention may be embodied otherwise without departing from such principles.

What is claimed is:

1. An electrical plug connector for telecommunication and data transfer applications, comprising:

a plug connector including a housing, RJ contacts disposed in said housing, insulation displacement contacts disposed in said housing and contact strips connecting said insulation displacement contacts and said RJ contacts;

a shield contact terminated at said plug connector, said shield contact including conduction means for connection to a cable shield of a high frequency cable for making an electrical connection; and clamp connection means for establishing contact between said shield contact and said cable shield;

intermediate ground wire contact means, in electrical contact with said shield contact and for electrical connection to a ground wire of the cable, said intermediate ground wire contact means being a separate piece than said shield contact.

2. An electrical plug connector according to claim 1, wherein said shield contact is formed to provide said plug connector with an electrical conductive enclosure, whereby impedance between the high frequency cable and the flanges is as low as possible.

3. An electrical plug connector according to claim 1, wherein said shield contact includes at least two lateral brackets and a rear wall, serving for attachment of the shield contact to said plug connector and for conductively connecting said intermediate ground wire contact means to said shield contact.

4. An electrical plug connector according to claim 3, wherein said intermediate ground wire contact means comprises ground wire means for contacting the ground wire, and includes a resilient metal sheet and hooks resiliently clamping down the intermediate ground wire.

5. An electrical plug connector according to claim 4, wherein said intermediate ground wire contact means is provided with fixing elements for attachment at said plug connector.

6. An electrical plug connector according to claim 5, wherein said fixing elements include barbs, webs, flanges and a rear wall portion.

7. An electrical plug connector for telecommunication and data transfer applications, comprising:

a plug connector including a housing, RJ contacts disposed in said housing, insulation displacement contacts disposed in said housing, said insulation displacement contacts being connected to said RJ contacts;

a shield contact terminated at said plug connector, said shield contact including conduction means for connection to a cable shield of a high frequency cable for making an electrical connection; and clamp connection means for establishing contact between said shield contact and said cable shield;

intermediate ground wire contact means, in contact with said shield contact and for electrical connection to a ground wire of the cable, said intermediate ground wire contact means being separate from said shield contact.

8. An electrical plug connector according to claim 7, wherein said shield contact is formed to provide said plug connector with an electrical conductive enclosure, whereby impedance between the high frequency cable and the flanges is as low as possible.

9. An electrical plug connector according to claim 8, wherein said shield contact includes at least two lateral brackets and a rear wall, serving for attachment of the shield contact to said plug connector and for conductively connecting said intermediate ground wire contact means to said shield contact.

10. An electrical plug connector according to claim 9, wherein said intermediate ground wire contact means comprises ground wire means for contacting the ground wire, and includes a resilient metal sheet and hooks resiliently clamping down the intermediate ground wire.

11. An electrical plug connector according to claim 10, wherein said intermediate ground wire contact means is provided with fixing elements for attachment at said plug connector.

12. An electrical plug connector comprising:

a housing including RJ contacts and including insulation displacement contacts in electrical contact with said RJ contacts;

a shield contact positioned on one end of said housing;

clamp connection means for clamping said shield contact to a cable and for electrically connecting said shield contact to a cable shield of the cable;

ground wire contact means formed separately from said shield contact and positioned on a side of said housing opposite said shield contact, said ground wire contact means being for electrically connecting said shield contact to a ground wire of the cable.

13. A connector according to claim 12, wherein:

said housing includes an RJ housing with a substantially flat end section and a socket section, said socket section defining a hollow space and an opening for receiving a plug, said socket section including said RJ contacts;

said shield contact is positioned on said socket section at an end of said socket section opposite said opening;

said ground wire contact means is positioned on a side of said RJ housing opposite said shield contact.

14. An electrical plug connector comprising:

a housing including RJ contacts and including insulation displacement contacts in electrical contact with said RJ contacts, said housing also including an RJ housing with a substantially flat end section and a socket section, said socket section defining a hollow space and an opening for receiving a plug, said socket section including said RJ contacts;

a shield contact positioned on said socket section at an end of said socket section opposite said opening;

clamp connection means for clamping said shield contact to a cable and for electrically connecting said shield contact to a cable shield of the cable;

ground wire contact means positioned on a side of said RJ housing opposite said shield contact and for electrically connecting said shield contact to a ground wire of the cable.

15. A connector according to claim 14, wherein:

said shield contact includes a plurality of lateral brackets extending from said end of said socket section along sides of said socket section toward said opening, said shield contact including a lip, said clamp connection means clamping said lip to a cable.

16. A connector according to claim 14, wherein:

said clamp connection means positions the cable adjacent said end of said socket section;

said housing also includes an IDC housing positioned on said substantially flat section and adjacent said socket section, said IDC housing including said insulation displacement contacts.

17. A connector according to claim 14, wherein:

said housing also includes an IDC housing positioned on said substantially flat section and adjacent said socket section, said IDC housing including said insulation displacement contacts;

said shield contact is positioned on said socket section at an end of said socket section substantially opposite said opening, said shield contact including a plurality of lateral brackets extending from said end of said socket section along sides of said socket section toward said opening, said shield contact including a lip;

said clamp connection means clamps said lip to the cable, said clamp connection means positioning the cable adjacent said end of said socket section;

said ground wire contact means is positioned on a side of said RJ housing substantially opposite IDC housing, said ground wire contact means including conductive webs extending along outside edges of said shield side, said ground wire contact means also including barb means positioned adjacent said opening and extending along said sides of said socket section, said barb means forming a sliding electrical contact between said conductive webs and said lateral brackets of said shield means, said ground wire contact means also including hook means for electrically connecting the ground wire to said conductive webs, said hook means includes first and second angled portions defining cut away portions to form inwardly rounded hooks, the ground wire being positionable in said cut away portions, said hook means also including a resilient sheet positioned between said first and second angled portions, said resilient sheet biasing the ground wire into said cut away portions.

18. A connector according to claim 14, wherein:

said ground wire contact means includes conductive webs extending along outside edges of said shield side, said ground wire contact means also includes barb means positioned adjacent said opening and extending along said sides of said socket section, said barb means forming a sliding electrical contact between said conductive webs and said lateral brackets of said shield means, said ground wire contact means also including hook means for electrically connecting the ground wire to said conductive webs.

19. A connector according to claim 17, wherein:

said hook means includes first and second angled portions defining cut away portions to form inwardly rounded hooks, the ground wire being positionable in said cut away portions, said hook means also including a resilient sheet positioned between said first and second angled portions, said resilient sheet biasing the ground wire into said cut away portions.

* * * * *